US006553863B1

(12) United States Patent
Djordjevic

(10) Patent No.: US 6,553,863 B1
(45) Date of Patent: Apr. 29, 2003

(54) ACCELERATOR PEDAL

(75) Inventor: Nebojsa Djordjevic, Willowdale (CA)

(73) Assignee: Atoma International Corp., Newmarket (CA)

( * ) Notice: Subject to any disclaimer, the term of this patent is extended or adjusted under 35 U.S.C. 154(b) by 0 days.

(21) Appl. No.: 09/548,222

(22) Filed: Apr. 12, 2000

Related U.S. Application Data

(60) Provisional application No. 60/130,366, filed on Apr. 21, 1999.

(51) Int. Cl.[7] ..... G05G 1/14

(52) U.S. Cl. ..... 74/512; 74/513; 74/560

(58) Field of Search ..... 74/512, 513, 560, 74/575; 188/290, 291, 77 W, 271; 192/12 BA, 57

(56) References Cited

U.S. PATENT DOCUMENTS

| | | | | |
|---|---|---|---|---|
| 3,875,820 A | * | 4/1975 | Morden | 74/512 |
| 4,516,439 A | | 5/1985 | Sagaser | |
| 4,528,590 A | | 7/1985 | Bisacquino et al. | |
| 4,779,713 A | * | 10/1988 | Tomala et al. | 192/88 A |
| 4,850,242 A | * | 7/1989 | Hass et al. | 74/512 |
| 4,944,269 A | | 7/1990 | Imoehl | |
| 5,133,321 A | | 7/1992 | Hering et al. | |
| RE34,301 E | | 7/1993 | Imoehl | |
| RE34,302 E | | 7/1993 | Imoehl | |
| RE34,574 E | | 4/1994 | Imoehl | |
| 5,321,980 A | | 6/1994 | Hering et al. | |
| 5,335,563 A | | 8/1994 | Yamamoto et al. | |
| 5,385,068 A | | 1/1995 | White et al. | |
| 5,408,899 A | | 4/1995 | Stewart | |
| 5,868,040 A | | 2/1999 | Papenhagen et al. | |
| 6,250,176 B1 | * | 6/2001 | Reimann et al. | 74/513 X |

FOREIGN PATENT DOCUMENTS

| | | | | |
|---|---|---|---|---|
| JP | 4-19256 | * | 1/1992 | 74/512 |
| JP | 4-50064 | * | 2/1992 | 74/512 |
| JP | 4-232158 | * | 8/1992 | 74/512 |

* cited by examiner

*Primary Examiner*—Vinh T. Luong
(74) *Attorney, Agent, or Firm*—Clark Hill PLC

(57) ABSTRACT

An accelerator pedal assembly has a mounting bracket and a pedal arm mounted to the bracket for pivotal movement between an idle position and a full throttle position. A biasing mechanism extends between the pedal arm and the bracket for urging the pedal arm to the idle position. A friction disc engages the biasing mechanism for movement therewith. The friction disc is in frictional engagement with a stationary friction plate for relative movement therebetween. Movement of the pedal arm from the idle position towards the full throttle position responsively rotates the friction disc relative to the friction plate and the biasing mechanism responsively increases frictional engagement between the friction disc and the friction plate by urging the friction disc and friction plate together.

11 Claims, 3 Drawing Sheets

12
17
17
28
146
34
23
14

ACCELERATOR PEDAL

This application claims benefit of Provisional No. 60/130,366 filed Apr. 21, 1999.

FIELD OF INVENTION

This invention relates to an improved accelerator pedal. In particular, this invention relates to an accelerator pedal for electronic control of a vehicle engine having improved hysteresis characteristics.

BACKGROUND OF INVENTION

Automotive engines utilizing electronic throttle control systems are now more common than conventional carbureted engines. In a carbureted engine, the accelerator pedal is connected to the throttle valve by a cable. Depressing the pedal rotates the throttle valve against the action of a return spring. The carbureted engine throttle control has established a certain "feel" for engine speed and acceleration. However, with electronic throttle control systems, a cable connection to the carburetor is no longer required, yet the same "feel" for acceleration is still desired.

U.S. Pat. No. 4,944,269 attempts to address the problem of an accelerator pedal for an electronic which produce sufficient hysteresis to the pedal shaft thereby producing the "feel" of a carbureted engine. This accelerator pedal utilizes three springs and numerous components making such an accelerator pedal relatively expensive to manufacture and assemble.

SUMMARY OF THE INVENTION

The disadvantages of the prior art may be overcome by providing an accelerator pedal having minimal of components which produces the desired hysteresis characteristics.

It is desirable to provide an accelerator pedal assembly having a mounting bracket and a pedal arm mounted to the bracket. The pedal arm pivots between an idle position and a full throttle position. A biasing mechanism extends between the pedal arm and the bracket for urging the pedal arm to the idle position. A friction disc engages the biasing mechanism for movement therewith. The friction disc is in frictional engagement with a stationary friction plate for relative movement therebetween. Movement of the pedal arm from the idle position towards the full throttle position responsively rotates the friction disc relative to the friction plate and the biasing mechanism responsively increases frictional engagement between the friction disc and the friction plate by urging the friction disc and friction plate together.

It is desirable to provide an accelerator pedal assembly comprising a mounting bracket, a pedal arm and a biasing mechanism. The arm is pivotally mounted to the bracket for movement between an idle position and a full throttle position. The biasing mechanism comprises a first coil extending between the pedal arm and the bracket, a second coil extending between the pedal arm and the bracket. The first coil engages and responsively rotates a first friction disc against a friction plate which mounted to the bracket. The second coil engages and responsively rotates a second friction disc against the friction plate. The biasing mechanism biases the arm to the idle position. As the arm is rotated towards the full throttle position, frictional resistance to the movement is produced by the first and second friction discs frictionally engaging the friction plate.

It is desirable to provide an accelerator pedal assembly comprising a mounting bracket, a pedal arm and a biasing mechanism. The arm is pivotally mounted to the bracket for movement between an idle position and a full throttle position. The biasing mechanism comprises a first coil extending between the pedal arm and the bracket. The first coil engages and responsively rotates a first friction disc against a friction plate which mounted to the bracket and a second friction disc mounted for frictional rotation relative to the arm. The biasing mechanism biases the arm to the idle position. As the arm is rotated towards the full throttle position, frictional resistance to the movement is produced by the first friction disc frictionally engaging the friction plate and by the second friction disc frictionally engaging the arm.

DESCRIPTION OF THE DRAWINGS

In drawings which illustrate an embodiment of the invention.

DESCRIPTION OF THE INVENTION

Figure 1:
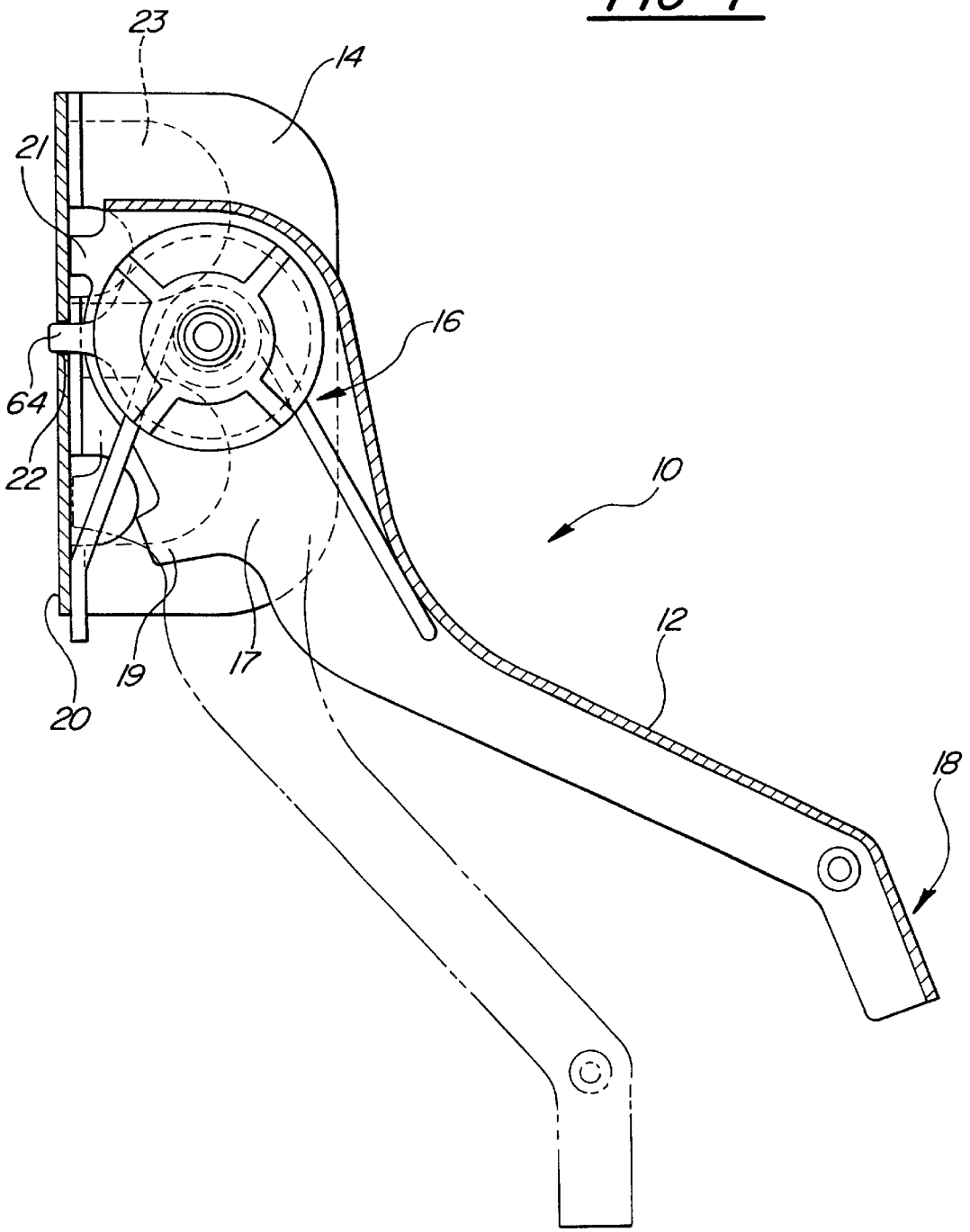
FIG. 1 is a side elevational view of a accelerator pedal of the present invention.

Referring to FIG. 1, there is illustrated an accelerator pedal assembly 10 of the present invention. The pedal assembly generally comprises a pedal arm 12, a mounting bracket 14 and a biasing mechanism 16.

Arm 12 is conventional in construction. Arm 12 is elongate and pivotally mounted to the bracket 14 at one end and has a pad 18 at an opposite distal end. The pivoted end has side spaced flanges 17 for pivotally mounting to the bracket 14. Arm 12 has stops 19 and 21 which limit the pivotal travel of the arm 12.

Bracket 14 is preferably a U-shape stamped and formed to present side flanges 23 between which the biasing mechanism 16 extends and pivotally mounts the arm 12. The mounting face 20 has a centrally located aperture 22.

Stop 19 contacts the mounting face 20 when the arm 12 is in the idle or stand-by position. Stop 19 contacts the mounting face 20 when the arm 12 is in the full throttle position. Biasing mechanism 16 biases arm 12 to the idle or stand-by position.

Figure 2:
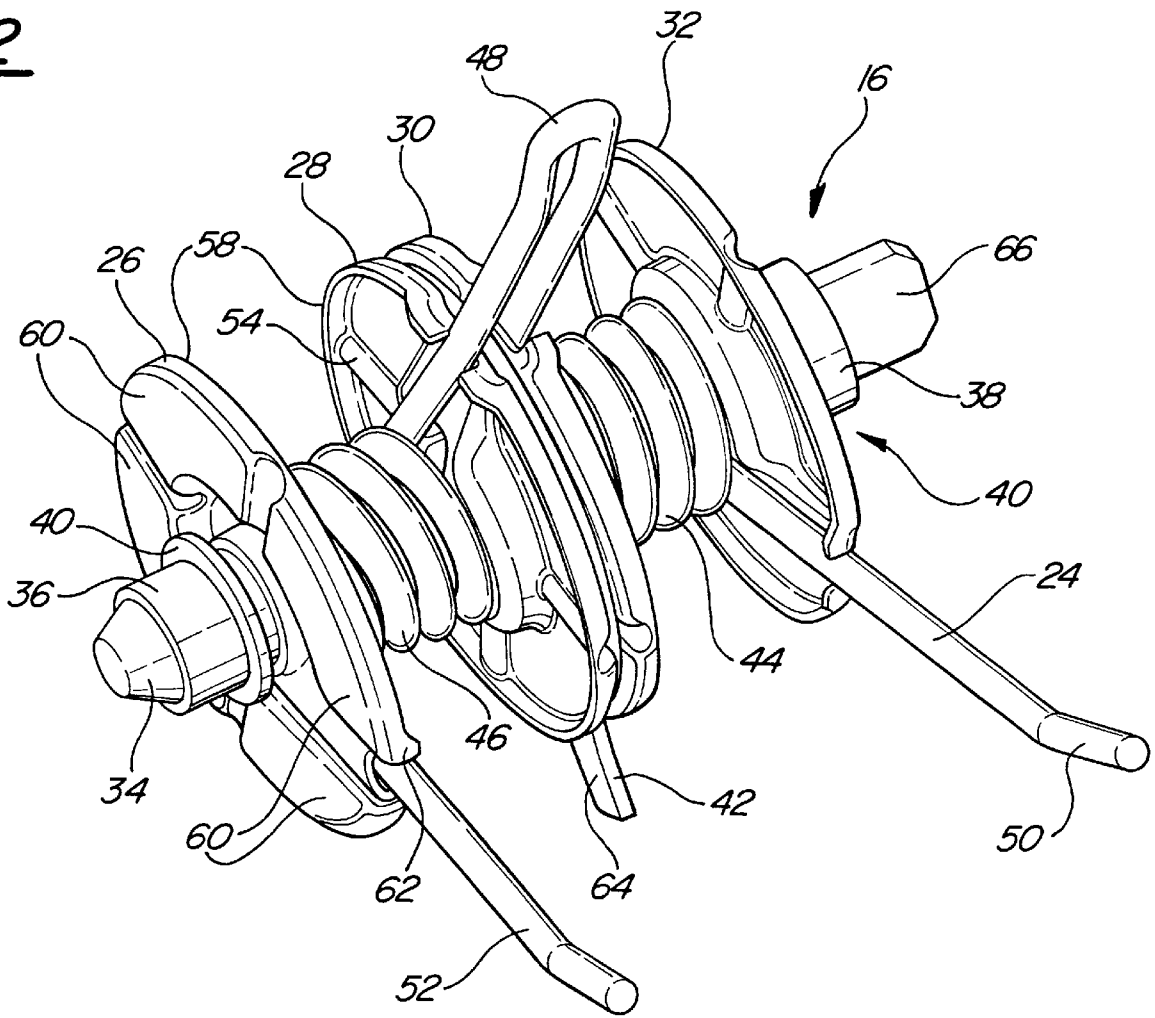
FIG. 2 is a perspective view of a biasing mechanism of the accelerator pedal of FIG. 1.

Referring to FIG. 2, the biasing mechanism 16 is illustrated in greater detail. The biasing mechanism 16 generally comprises a single spring 24, discs 26, 28, 30, 32, spindle 34, bushings 36, 38, washers 40 and friction plate 42.

Spring 24 is a double wound spring defining first and second coils 44, 46, tab 48 and ends 50 and 52. Spring 24 is wound symmetrically and in opposite senses taking the midpoint of tab 48 as the reference. The diameter of coils 44, 46 enables the spring to be mounted on spindle 34. Coils 44, 46 have an axial extent such to be slightly less than the spacing between flanges 17 of arm 12.

Discs 26, 28, 30, 32 are identical, thereby minimizing part count. The discs are preferably stamped and formed from sheet steel. Each disc has a hub 56 for mounting on spindle 34, four radially extending ribs 54 extending between hub 56 and an outer rim 58. The convex side of the web between the hub 56 and outer rim 58 presents a friction surface 60. At least one of area of the outer rim has a cut out 62 defining two tangs which frictionally engage the spring 24.

The discs are mounted on the spindle 34 such that the friction surface 60 on discs 26 and 32 engage the side flanges 17 of the arm 12 and on discs 28 and 30 face each other. Coils 46, 44 engage discs 26, 28 and 30, 32, respectively producing the desired frictional resistive forces. The ends 50, 52 hold discs 32, 26 respectively to allow the discs 32, 26 to rotate relative to the arm 12 as it rotates between the idle position and the full throttle position.

Spindle 34 extends from the side flanges of the bracket 14 to pivotally mount arm 12. Bushings 36, 38 and washers 40 journal mount the spindle 34 on the bracket 14. One end of spindle 34 has a flattened tab 66 which is configured to engage a throttle control device as described in U.S. Pat. Nos. 5,133,321; 5,321,980. The throttle control device is coupled to the electronic ignition module for controlling the speed of the engine.

Friction plate 42 has a generally circular shape with a central bore for mounting on spindle 34. The plate 42 has a tab 64 which extends into aperture 22 of bracket 14 and is thus restrained from rotating. The plate 42 is sandwiched between discs 28 and 30 which is sandwiched between coils 44, 46 and within tab 48.

The strength of the spring 24 and diameter of the friction plate 42 and the discs 26, 30 28, 30, 32 are selected to produce a desired amount of frictional forces.

Once assembled, tab 48 will engage arm 12 and ends 52, 54 of spring 24 will engage the bracket 14. Spring 24 biases arm 12 of the pedal assembly 10 outwardly to the idle engine speed position. Stop 21 engages the bracket 14. As the operator presses on pad 18, tab 48 of spring 24 will be rotated. The tab 48 will responsively rotate the discs 28 and 30. The discs 28, 30 will rotate relative to plate 42 providing frictional resistance to the operator's foot movement. Additionally, rotation of the arm 12 winds coils 44, 46 which urges the discs 26, 28 and 30, 32 apart thereby increasing frictional forces. Continued pressure will rotate the arm 12 to the full throttle position where stop 19 will engage the bracket.

On release of pressure from the operator's foot, the spring 24 will urge the arm 12 back towards the idle engine speed position, the coils 44, 46 will unwind, releasing the friction engagement of the discs 26, 28, 30 and 32.

Thus, as the operator presses on the pad 18, the resistance to the pressure increases and as the operator releases the pressure the pedal returns smoothly without resistance thereby simulating the "feel" of a carbureted engine accelerator pedal.

Figure 3:
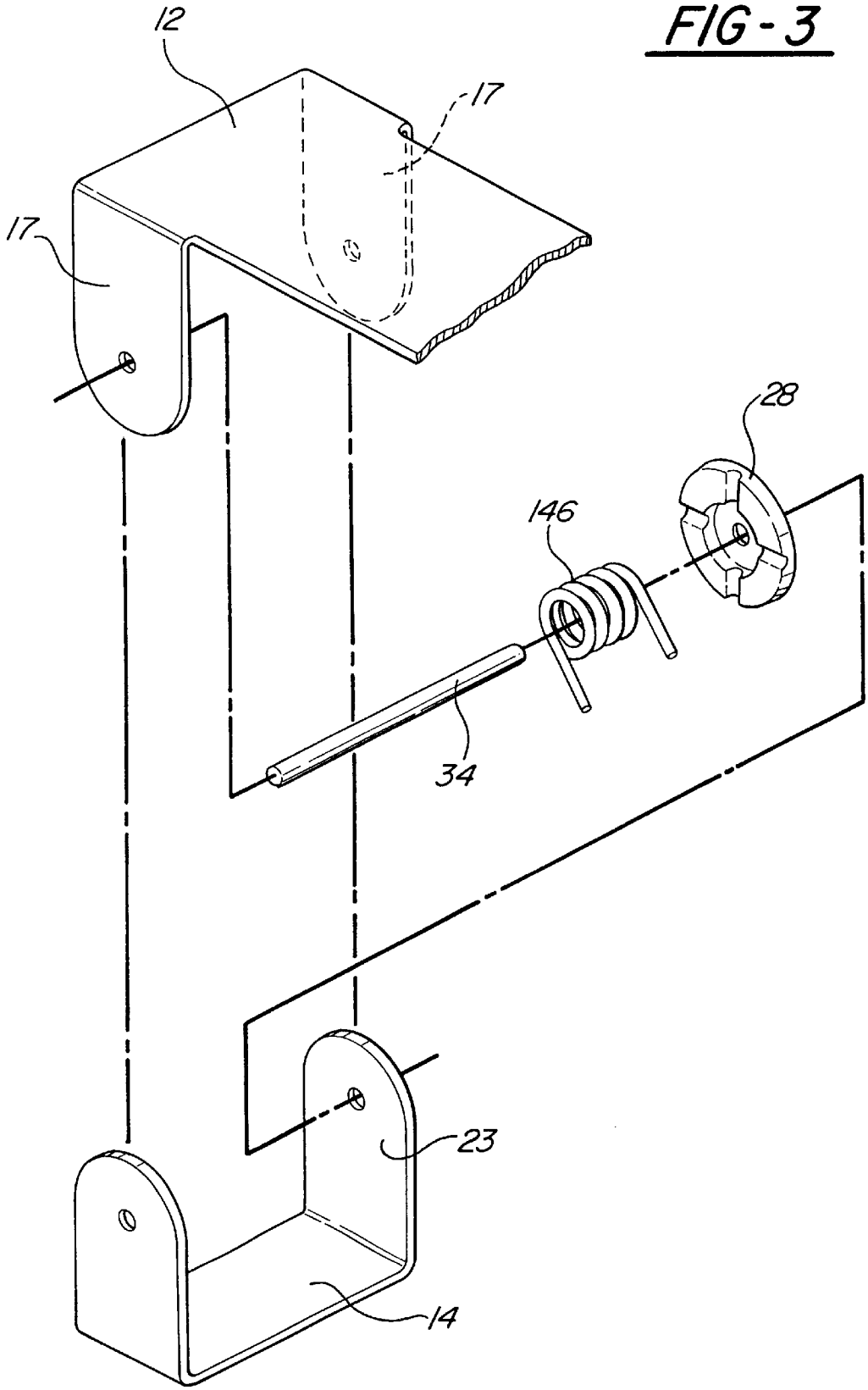
FIG. 3 is an exploded perspective view of a second embodiment of the present invention.

In the preferred embodiment, the spring 24 is illustrated and described as a single spring. It is now apparent to those skilled in the art that the spring could be replaced by two springs, each wound in an opposite sense as the other. Additionally, a suitable accelerator pedal could be made using a single coil spring 146 engaging at least one disc 28 which is sized to produce sufficient frictional forces. The arm 12 has a pair of spaced flanges 17 and the bracket 14 has a pair of spaced flanges 23. The arm 12 is mounted in an offset relation with the bracket 14 and the disc 28 acts against one of the bracket flanges 23 as illustrated in FIG. 3. However, current safety regulations in North America require that the accelerator assembly have at least two springs or coils and thus a second spring will be required.

The above-described embodiment of the invention is intended to be an example of the present invention and alterations and modifications may be effected thereto, by those of skill in the art, without departing from the scope of the invention.

What is claimed is:

1. An accelerator pedal assembly comprising:

a mounting bracket, a pedal arm mounted to the bracket for pivotal movement between an idle position and a full throttle position, a biasing mechanism extending between the pedal arm and the bracket for urging said pedal arm to the idle position, said biasing mechanism comprises a coil having a first and second ends with said second end engaging the mounting bracket, a stationary friction plate, a first friction disc engaging said first end of said coil for movement therewith, said first friction disc in frictional engagement with said friction plate, a second friction disc engaging said second end of said coil, said second friction disc frictionally engaging said pedal arm, wherein movement of said pedal arm from said idle position towards said full throttle position responsively rotates said first friction disc relative to said friction plate and said biasing mechanism responsively increases friction engagement between the first friction disc and the friction plate and said movement of said pedal arm winds said coil to axially extend said coil urging said first friction disc axially and thereby effect said increase in frictional engagement between said first friction disc and said friction plate.

2. An accelerator pedal assembly as claimed in claim 1 wherein said friction plate engages said bracket.

3. An accelerator pedal assembly as claimed in claim 1 wherein said friction plate is integral with said bracket.

4. An accelerator pedal assembly as claimed in claim 1 wherein said assembly further comprises a spindle on which said pedal is mounted, said spindle having an end adapted for operative engagement with an electronic speed control device.

5. An accelerator pedal assembly comprising:

a mounting bracket, a pedal arm mounted to the bracket for pivotal movement between an idle position and a full throttle position, a biasing mechanism extending between the pedal arm and the bracket for urging said pedal arm to the idle position, a stationary friction plate, a first friction disc engaging said biasing mechanism for movement therewith, said first friction disc in frictional engagement with said friction plate, movement of said pedal arm from said idle position towards said full throttle position responsively rotates said first friction disc relative to said friction plate and said biasing mechanism responsively increases friction engagement between the first friction disc and the friction plate, and said biasing mechanism comprises a first coil having a first end engaging said first friction disc and a second end engaging the mounting bracket and a second coil having a first end engaging a second friction disc and a second end engaging the mounting bracket, said second friction disc in frictional engagement with said friction plate on a side thereof opposite said first friction disc, said movement of said pedal arm winds said coil to axially extend said coils urging said friction discs axially and thereby effect said increase in frictional engagement between said friction discs and said friction plate.

6. An accelerator pedal assembly as claimed in claim 5 wherein said assembly further comprises a third friction disc engaging said second end of said first coil, said third friction disc frictionally engaging said pedal arm, and a fourth friction disc engaging said second end of said second coil, said fourth friction disc frictionally engaging said pedal arm.

7. An accelerator pedal assembly as claimed in claim 6 wherein said first and second coils are commonly wound and integral with each other.

8. An accelerator pedal assembly as claimed in claim 7 wherein said first coil and said second coil are wound in opposite senses.

9. An accelerator pedal assembly as claimed in claim 8 wherein said friction plate engages said bracket.

10. An accelerator pedal assembly as claimed in claim 8 wherein said friction plate is integral with said bracket.

11. An accelerator pedal assembly as claimed in claim 5 wherein said assembly further comprises a spindle on which said pedal is mounted, said spindle having an end adapted for operative engagement with an electronic speed control device.

* * * * *